US010205261B2

(12) United States Patent
Machida et al.

(10) Patent No.: US 10,205,261 B2
(45) Date of Patent: Feb. 12, 2019

(54) CONNECTION TERMINAL

(71) Applicants: Yazaki Corporation, Tokyo (JP); TOYOTA JIDOSHA KABUSHIKI KAISHA, Aichi-ken (JP)

(72) Inventors: Kengo Machida, Shizuoka (JP); Yasuhiro Tanaka, Shizuoka (JP); Hiroshi Kobayashi, Aichi-ken (JP)

(73) Assignees: YAZAKI CORPORATION, Tokyo (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/970,710

(22) Filed: May 3, 2018

(65) Prior Publication Data

US 2018/0337479 A1 Nov. 22, 2018

(30) Foreign Application Priority Data

May 18, 2017 (JP) ..... 2017-099155

(51) Int. Cl.
*H01R 13/187* (2006.01)
*H01R 13/11* (2006.01)
*H01R 4/18* (2006.01)

(52) U.S. Cl.
CPC ..... *H01R 13/111* (2013.01); *H01R 4/184* (2013.01)

(58) Field of Classification Search
CPC ..... H01R 13/187
USPC ..... 439/843
See application file for complete search history.

(56) References Cited

U.S. PATENT DOCUMENTS

| | | | | |
|---|---|---|---|---|
| 6,899,571 | B1 * | 5/2005 | Koch | H01R 4/4881 439/843 |
| 7,048,596 | B2 * | 5/2006 | Swearingen | H01R 4/4881 439/843 |
| 7,118,428 | B2 * | 10/2006 | Gamaggio | H01R 13/187 439/843 |
| 7,462,078 | B2 * | 12/2008 | Mao | H01R 13/187 439/843 |
| 7,828,609 | B2 * | 11/2010 | Li | H01R 13/187 29/862 |
| 9,236,682 | B2 * | 1/2016 | Glick | H01R 13/62 |
| 9,608,341 | B2 * | 3/2017 | Saur | H01R 4/48 |
| 2016/0254610 | A1 * | 9/2016 | Hirakawa | H01R 13/187 439/816 |
| 2018/0337479 | A1 * | 11/2018 | Machida | H01R 13/111 |

FOREIGN PATENT DOCUMENTS

| | | |
|---|---|---|
| JP | 5579213 B2 | 8/2014 |
| JP | 2015-76199 A | 4/2015 |

* cited by examiner

*Primary Examiner* — Neil Abrams
(74) *Attorney, Agent, or Firm* — Kenealy Vaidya LLP

(57) ABSTRACT

A connection terminal includes a contact member including a first contact unit having an arcuate outer periphery that is formed along an inner periphery of the female connector and is electrically connected to a female connector, and a second contact unit that is connected to the first contact unit and pushed outward in a radial direction by the male connector inside the internal space so as to be electrically connected to the male connector, and an uplift prevention unit that is locked not to move inward in the radial direction at an outer wall surface of the female connector and is configured to prevent an uplift of the first contact unit from the inner periphery of the female connector.

6 Claims, 18 Drawing Sheets

CONNECTION TERMINAL

CROSS-REFERENCE TO RELATED APPLICATION(S)

The present application claims priority to and incorporates by reference the entire contents of Japanese Patent Application No. 2017-099155 filed in Japan on May 18, 2017.

BACKGROUND OF THE INVENTION

1. Field of the Invention

The present invention relates to a connection terminal.

2. Description of the Related Art

In the related art, there is known a connection terminal including: a terminal body which includes a female connector provided with a pillar-like internal space into which a male connector of a counterpart male terminal is inserted; and a contact member which is housed in the internal space and is electrically connected to both of the female connector and the male connector. Such a connection terminal is disclosed, for example, in Japanese Patent Application Laid-open No. 2015-76199 and Japanese Patent No. 5579213.

In the aforementioned connection terminal, the contact member is configured to have elasticity and formed in a cylindrical shape along an inner periphery of the female connector. When the male connector is inserted into this cylindrical portion, spring force of the contact member is used to electrically connect the female connector and the male connector. Such a connection terminal may cause the contact member to uplift from the inner periphery of the female connector. In a conventional connection terminal, for example, when a cylindrical contact member is inserted into an internal space while being reduced in diameter, the contact member is deformed until reaching a plastic range, causing a decrease in spring force with respect to an inner periphery of a female connector. With this decreased spring force, the contact member may be uplifted from the inner periphery of the female connector. Such an uplift of the contact member in the conventional connection terminal causes a male connector to interfere with the contact member at the time of insertion, which may lead to a decrease in durability and a decrease in workability of inserting the male connector.

SUMMARY OF THE INVENTION

A purpose of the present invention is to provide a connection terminal capable of preventing an uplift of a contact member from an inner periphery of a female connector.

In order to achieve the above mentioned object, a connection terminal according to one aspect of the present invention includes a terminal body that is formed of a conductive material and includes a female connector provided with an internal space having a cylindrical shape into which a male connector of a counterpart male terminal is inserted, and a wire connector to which a conductive unit of a wire is electrically connected, and a contact member that is formed of a conductive material, is housed in the internal space along a part of an inner periphery of the female connector in a circumferential direction, is electrically connected to the female connector, and is electrically connected to the male connector inserted into the internal space from an opening serving as a male terminal inlet port in the female connector. The contact member includes a first contact unit that is formed into an arc along the circumferential direction of the inner periphery of the female connector with an arcuate outer periphery being electrically connected to the inner periphery of the female connector, a second contact unit that is disposed in the internal space while being connected to the first contact unit and is pushed outward in a radial direction of the internal space by the male connector inserted into the internal space and is electrically connected to the male connector, and an uplift prevention unit that is locked not to move inward in the radial direction at an outer wall surface of the female connector to prevent an uplift of the first contact unit from the inner periphery of the female connector.

According to another aspect of the present invention, in the connection terminal, the uplift prevention unit may be disposed outside the female connector in the radial direction, and may include a locked unit that is locked not to move inward in the radial direction at the outer wall surface of the female connector and a coupling unit that couples the locked unit with the first contact unit.

According to still another aspect of the present invention, in the connection terminal, the contact member may include at least two first contact units arranged at an interval in an axial direction of the female connector and a plurality of second contact units serving as coupling units to couple the two adjacent first contact units with each other, and the second contact units may be formed into an arc projecting inward in the radial direction between the two adjacent first contact units so as to be bent outward in the radial direction when being pushed outward in the radial direction by the male connector inserted into the internal space.

According to still another aspect of the present invention, in the connection terminal, the uplift prevention unit may be connected to the first contact unit disposed close to the opening of the female connector.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a connection terminal according to the present invention will be described in detail with reference to the drawings. It should be noted that the present invention is not limited by this embodiment.

Embodiment

An embodiment of a connection terminal according to the present invention will be described with reference to FIGS. 1 to 6.

Figure 1:
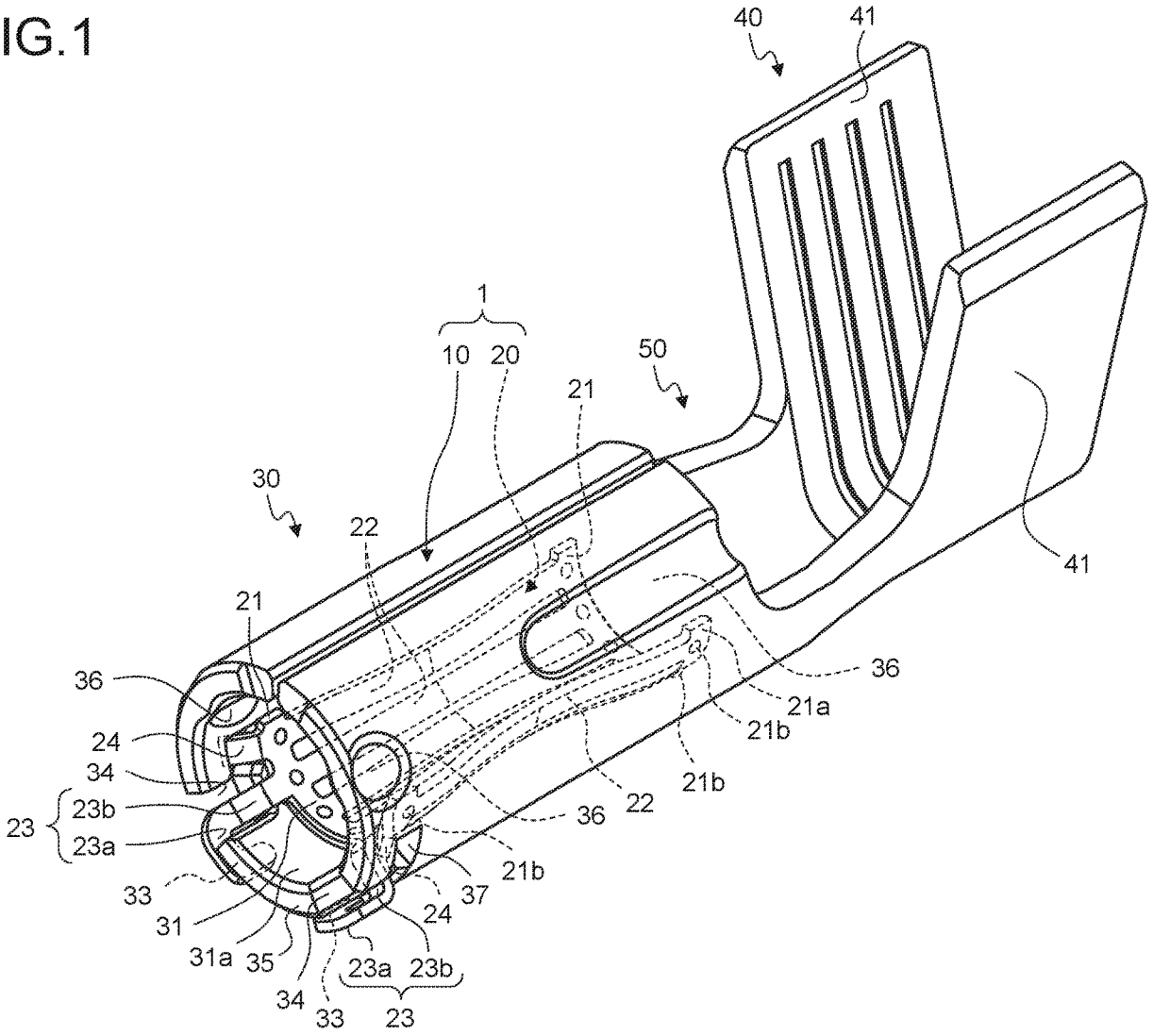
FIG. 1 is a perspective view illustrating a connection terminal according to an embodiment.
Figure 2:
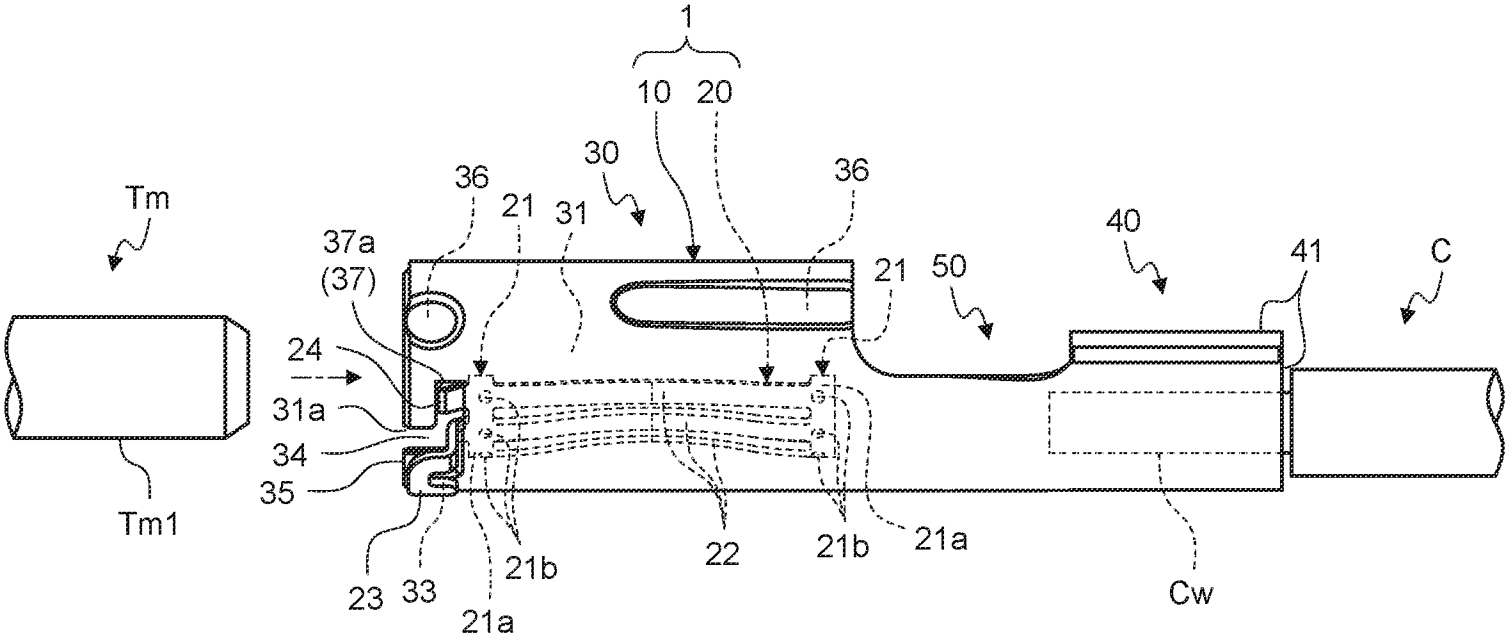
FIG. 2 is a side view illustrating the connection terminal according to the embodiment.

The reference numeral 1 in FIGS. 1 to 4 denotes a connection terminal of this embodiment. This connection terminal 1 is what is called a female terminal which is physically and electrically connected to a counterpart male terminal Tm (FIG. 2). The connection terminal 1 includes a terminal body 10 and a contact member 20, and these two components are attached to each other so as to form the connection terminal 1.

The terminal body 10 is formed of a conductive material such as metal. This exemplified terminal body 10 is formed by a press work, such as cutting and bending, with a conductive metal plate used as a base material. The terminal body 10 includes a female connector 30, a wire connector 40, and a coupler 50.

The female connector 30 is a female component into which a male connector Tm1 of the male terminal Tm is inserted. With the male connector Tm1 being inserted into the female connector 30, both connectors are electrically connected. Herein, the female connector 30 is formed in a cylindrical shape provided with an internal space 31 that is formed in accordance with a shape of the pillar-like male connector Tm1. In the female connector 30, at least one end in an axial direction of its cylindrical body is configured to be opened. An opening 31*a* at one end of the female connector 30 is used as an inlet port (a male terminal inlet port) allowing insertion of the male connector Tm1 into the internal space 31 and is also used as an inlet port (a contact member inlet port) allowing insertion of the contact member 20 into the internal space 31. Furthermore, the opening 31*a* is used as an outlet port when the male connector Tm1 is withdrawn from the internal space 31. In this exemplified embodiment, the internal space 31 of the female connector 30 and the male connector Tm1 are formed into a cylindrical shape which enables insertion and withdrawal between each other. This exemplified female connector 30 is not limited in appearance, but is formed to have at least the cylindrical internal space 31 so that the male connector Tm1 is inserted into or withdrawn from the internal space 31 along an axis of the female connector 30. Herein, the plate-like base material is bent and processed to form the female connector 30 into the cylindrical shape, thereby forming the cylindrical internal space 31 inside the female connector 30.

The wire connector 40 is a section to which a conductive unit Cw (FIG. 2) of a wire C is electrically connected. The connection may be provided, for example, by crimping such as swage, by welding, and by soldering. In this exemplified embodiment, the base material is bent and processed to form the wire connector 40 into a U-shape. The wire connector 40 has two barrel pieces 41 opposing to each other. Each barrel piece 41 is wound around a core of the wire C serving as the conductive unit Cw and is crimped to the conductive unit Cw so as to be physically and electrically connected to this conductive unit Cw.

The coupler 50 is a section interposed between the female connector 30 and the wire connector 40 and is configured to connect these connectors.

The contact member 20 is formed along an inner periphery 32 (FIG. 4) of the female connector 30 in the terminal body 10 and is housed in the internal space 31 of the female connector 30 from the opening 31*a*. While being housed, the contact member 20 is electrically connected to the female connector 30 and is electrically connected to the male connector Tm1 housed in the internal space 31 from the opening 31*a*. The contact member 20 is formed of a conductive material such as metal. This exemplified contact member 20 is formed by a press work, such as cutting and bending, with a conductive metal plate used as a base material.

While diminishing in size, the contact member 20 herein appropriately changes curvature of each position in the axial direction (a direction along an inserting direction into the internal space 31). With each position being closely disposed, the contact member 20 is inserted into the internal space 31. However, as similar to a conventional contact member, when this contact member 20 forms a cylindrical shape inside an internal space of a female connector, an amount of curvature change becomes large at the time of insertion, which may lead to a decrease in durability. Furthermore, in such a contact member that forms a cylindrical shape, the amount of curvature change in the axial direction at each position becomes large so that it may be difficult to insert the contact member into the internal space of the female connector. Even in a case where such a contact member is wrapped inside a female connector when forming the female connector into a cylindrical shape instead of inserting the contact member into the female connector, the contact member is required to be disposed on a base material of the female connector, while cylindrically diminishing in size. Therefore, conventional connection terminals have room for improvement in durability and productivity.

Accordingly, appearance of this contact member 20 is formed along a part of the inner periphery 32 of the female connector 30 in a circumferential direction. Since the internal space 31 of this exemplified contact member 20 is formed in the cylindrical shape, the appearance is shaped in such a manner that each position in the axial direction forms an arc. In regard to a size of the arc, the center angle is set within a range where the arc does not form a circular ring. Therefore, this connection terminal 1 enables insertion of the contact member 20 into the internal space 31 while suppressing the amount of curvature change to a lower level than that in a case of using a conventional cylindrical contact member. Accordingly, this contact member 20 is capable of controlling the amount of curvature change at the time of insertion so that the amount falls within an elastic range, which improves durability of the contact member 20. Furthermore, this contact member 20 enables improvement in productivity of this connection terminal 1.

Specifically, the contact member 20 includes a first contact unit 21 which is electrically connected to the female connector 30, and a second contact unit 22 which is electrically connected to the male connector Tm1 housed in the internal space 31.

The first contact unit 21 is formed in an arc along the circumferential direction of the inner periphery 32 of the female connector 30, and an arcuate outer periphery 21*a* (FIG. 5) of the first contact unit 21 is electrically connected to the inner periphery 32 of the female connector 30. A plurality of spherical contact points 21*b* bulging outward in a radial direction is formed on this exemplified outer periphery 21*a*. These contact points 21*b* are arranged at substantially equal intervals along the circumferential direction of the outer periphery 21*a*. The first contact unit 21 is brought into contact with the inner periphery 32 of the female connector 30 through each of these contact points 21*b*.

The second contact unit 22 is disposed in the internal space 31, while being connected to the first contact unit 21. This second contact unit 22 is pushed outward in the radial direction of the internal space 31 (toward the inner periphery 32) by the male connector Tm1 inserted into the internal space 31. This second contact unit 22 comes in contact with the male connector Tm1 at a portion where the second contact unit 22 is pushed (a pushed portion) and is electrically connected to the male connector Tm1 with the pushed portion serving as a contact point.

The contact member 20 includes at least one first contact unit 21 and one second contact unit 22. For example, the contact member 20 has at least two first contact units 21 arranged at an interval along the axial direction (a direction of insertion and withdrawal) of the female connector 30, and a plurality of second contact units 22 as coupling units configured to couple the two adjacent first contact units 21 with each other. The first contact units 21 and the internal space 31 are arranged concentrically, and the first contact units 21 are offset with each other in the axial direction. When being pushed outward in the radial direction of the internal space 31 by the male connector Tm1 inserted into the internal space 31, each of the second contact units 22 is bent outward in the radial direction. Herein, a section between two adjacent first contact units 21 is formed into an arc projecting inward in the radial direction, and a vertex of the arc projecting inward in the radial direction serves as the pushed portion or the contact point.

The contact member 20 opposes an approximately half area of the inner periphery 32 of the female connector 30 in the circumferential direction. In this exemplified embodiment, the contact member 20 is disposed in a section linked to a coupling unit that couples the barrel pieces 41 with each other (for example, a section close to a base of the internal space 31 in the sheet of FIG. 3). However, the circumferential position of this contact member 20 in the internal space 31 is not necessarily limited to an aspect of this exemplary embodiment and may be any position in the circumferential direction.

In this contact member 20, before the male connector Tm1 is inserted into the internal space 31, it is desirable that the contact point 21*b* of the first contact unit 21 is brought into contact with the inner periphery 32 of the female connector 30. In other words, as the first contact unit 21 is prevented from being uplifted from the inner periphery 32 of the female connector 30 before insertion of the male connector Tm1, it is desirable to prevent an uplift of the contact member 20 from the inner periphery 32 in whole.

Therefore, the connection terminal 1 according to this embodiment is provided with an uplift preventing structure configured to prevent an uplift of the contact member 20 from the inner periphery 32 of the female connector 30. The uplift preventing structure includes an uplift prevention unit 23 provided in the contact member 20, and a locking unit 33 provided in the female connector 30 (FIGS. 1 to 4, and FIG. 6).

The uplift prevention unit 23 is locked at an outer wall surface of the female connector 30 so as not to move inward in the radial direction. With the uplift prevention unit 23 being locked, the first contact unit 21 is prevented from being uplifted from the inner periphery 32 of the female connector 30. Therefore, the uplift prevention unit 23 is provided as being connected to the first contact unit 21. In this exemplified embodiment, the uplift prevention unit 23 is connected to the first contact unit 21 disposed on a side close to the opening 31*a* of the female connector 30 (a side close to the male terminal inlet port).

Specifically, the uplift prevention unit 23 of this embodiment is disposed outside the female connector 30 in the radial direction, and includes a locked unit 23*a* which is locked not to move inward in the radial direction at the outer wall surface of the female connector 30 and a coupling unit 23*b* which couples this locked unit 23*a* with the first contact unit 21 which is a target of coupling (FIG. 1, and FIGS. 3 to 5). The locking unit 33 is placed to oppose the locked unit 23*a* in the radial direction. In this exemplified embodiment, the female connector 30 is formed in the cylindrical shape so that a part of an outer periphery of the female connector 30 is used as the locking unit 33.

In the uplift prevention unit 23, the coupling unit 23*b* protrudes outward in the radial direction from the first contact unit 21 which is the target of coupling, and the locked unit 23*a* protrudes in the circumferential direction from a protruding end of the coupling unit 23*b*. Each of the exemplified locked unit 23*a* and the coupling unit 23*b* is formed into a piece. For example, the coupling unit 23*b* is formed into a substantially rectangular piece with one flat surface being disposed to oppose an end of the female connector 30 close to the opening 31*a*. The locked unit 23*a* is formed into an L-shaped piece, and is disposed such that an L-shaped inner wall surface at an inner side in the radial direction opposes the outer periphery of the female connector 30. Herein, the outer periphery of the female connector 30 opposing the locked unit 23*a* serves as the locking unit 33. The exemplified locked unit 23*a* is formed to curve along the outer periphery of the female connector 30, and is disposed such that the curved L-shaped inner surface at an inner side in the radial direction opposes the outer periphery. In this exemplified embodiment, a first side of the L-shaped piece protrudes in the circumferential direction from the protruding end of the coupling unit 23*b*, and a second side of the L-shaped piece protrudes in the axial direction of the female connector 30 from a protruding end on the first side. Herein, the second side of the piece in the locked unit 23*a* protrudes in a direction in which the contact member 20 is inserted into to the female connector 30 (a direction in which the male connector Tm1 is inserted). When the contact member 20 is attached to the female connector 30, this locked unit 23*a* may be brought into contact with the locking unit 33 or may leave a space with respect to the locking unit 33. In a case of leaving a space, it should be noted that the space is set so as to prevent an uplift of the contact member 20 from the inner periphery 32 of the female connector 30 when the locked unit 23*a* is locked by the locking unit 33.

At least one uplift prevention unit 23-and-locking unit 33 set may be provided in the circumferential direction. In this embodiment, two uplift prevention unit 23-and-locking unit 33 sets are provided at an interval in the circumferential direction. The locked unit 23*a* of a first set protrudes in the circumferential direction toward the locked unit 23*a* of a second set. The locked unit 23*a* of the second set protrudes in the circumferential direction toward the locked unit 23*f* of the first set.

The female connector 30 includes a notch 34 formed at the end close to the opening 31*a* (FIGS. 1 to 4). The notch 34 communicates an inner side of the female connector 30 in the radial direction (the internal space 31) and an outer side thereof. The coupling unit 23*b* is disposed in the notch 34 so as to link the inner side and the outer side thereof. This notch 34 is formed for each coupling unit 23*b*. In this female connector 30, the outer periphery of one arcuate portion 35 sandwiched by the notches 34 in the circumferential direction is used as the locking unit 33. One arcuate portion 35 herein is a side having the shorter arc length.

In such manners, the connection terminal 1 of this embodiment is provided with the structure to prevent an uplift of the contact member 20. Therefore, in this connection terminal 1, when the contact member 20 begins to uplift from the inner periphery 32 of the female connector 30, the locked unit 23*a* in the uplift prevention unit 23 of the contact member 20 is locked by the locking unit 33 in the outer periphery of the female connector 30 so that the uplift prevention unit 23 is prevented from moving inward in the radial direction. At this time, in this connection terminal 1, the first contact unit 21, or the target of coupling, is prevented from being uplifted from the inner periphery 32 of the female connector 30, and accordingly, the second contact unit 22 is prevented from being uplifted from the inner periphery 32 of the female connector 30, which results in preventing an uplift of the contact member 20 from the inner periphery 32 of the female connector 30.

Therefore, when the male connector Tm1 is inserted into the internal space 31 of the female connector 30, the connection terminal 1 avoids interference of the male connector Tm1 with the contact member 20 and enables this male connector Tm1 to push the second contact unit 22 outward in the radial direction. Accordingly, this connection terminal 1 not only enables electrical connection between the female connector 30 and the contact member 20 and between the male connector Tm1 and the contact member 20, but also improves durability of the contact member 20. Furthermore, this connection terminal 1 improves not only the durability of the connection terminal 1 but also durability of the male connector Tm1.

Still further, since this connection terminal 1 enables prevention of an uplift of the contact member 20, the contact member 20 can be prevented from falling off the female connector 30 even with the female connector 30 not being covered with a lid and the like. Accordingly, the connection terminal 1 enables improvement in workability of inserting the male connector Tm1.

With regard to effects and adventitious effects in preventing an uplift of the contact member 20, the connection terminal 1 of this embodiment can be configured to include minimum necessary components such as the terminal body 10 and the contact member 20 as described above. Thus, this connection terminal 1 enables improvement in its productivity and reduction in its cost, and when being combined with the male terminal Tm inserted thereinto, the connection terminal 1 enables improvement in productivity and reduction in cost of the male terminal Tm.

Figure 3:
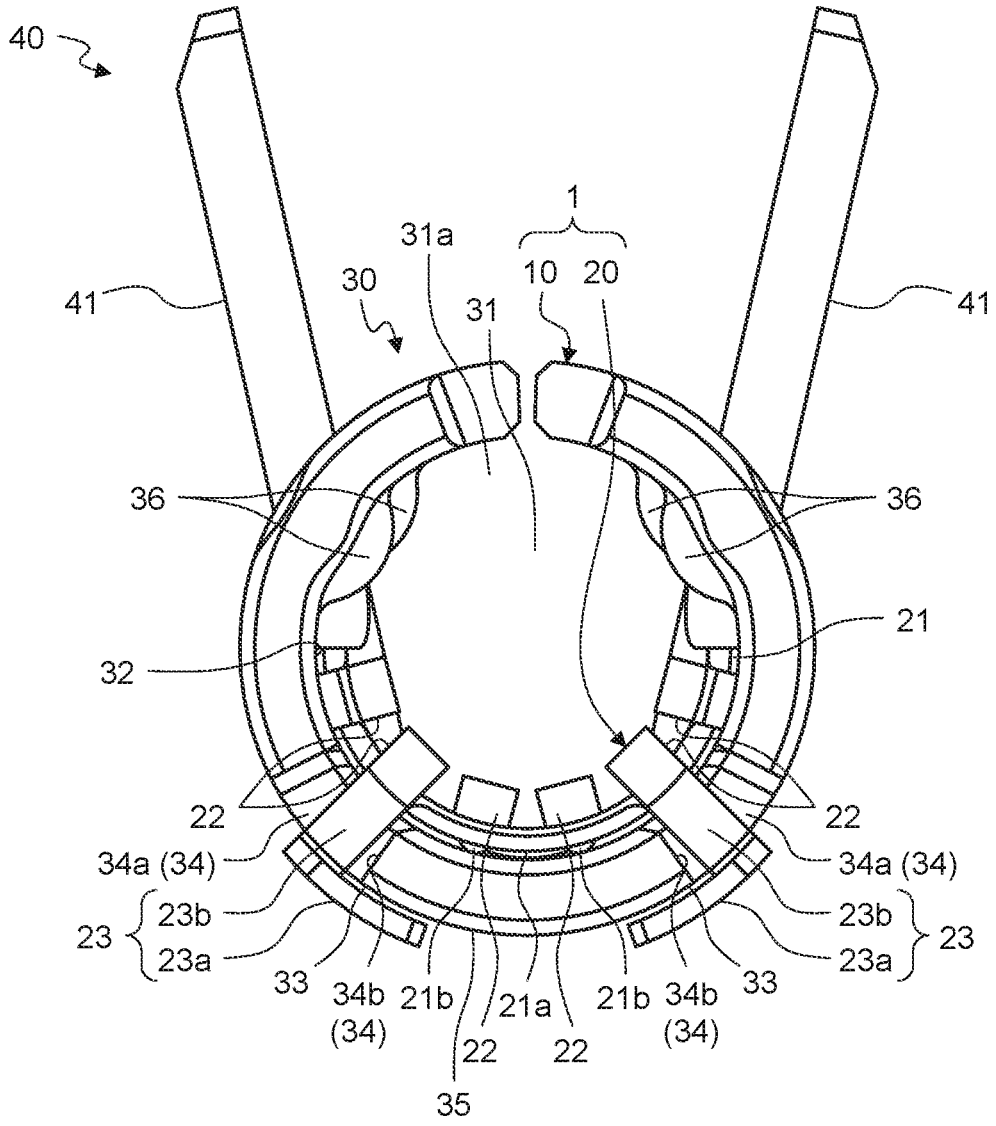
FIG. 3 is a front view illustrating the connection terminal according to the embodiment.

In the female connector 30 of this embodiment, a plurality of contact units 36 is provided in the inner periphery 32 where the contact member 20 is not disposed (FIG. 3). Each of those contact units 36 is formed as a bulging portion bulging inward in the radial direction in the internal space 31. The male connector Tm1 housed in the internal space 31 is sandwiched by the contact member 20 and those contact units 36. The contact member 20 and those contact units 36 ensure holding force in the internal space 31. Therefore, the male connector Tm1 is electrically connected to the female connector 30 in an indirect manner through the contact member 20, and in a direct manner by the contact units 36.

This exemplified female connector 30 includes four contact units 36. Specifically, two contact units 36 are provided at the end close to the opening 31*a* at an interval in the circumferential direction, and two contact units 36 are provided at an end close to the coupler 50 at an interval in the circumferential direction (FIGS. 1 to 4). The contact units 36 close to the opening 31*a* are spherical bulging portions bulging inward in the radial direction from the inner periphery 32. The contact units 36 close to the coupler 50 are arcuate bulging portions bulging inward in the radial direction from the inner periphery 32, extending in the axial direction.

The connection terminal 1 is also provided with a positional shift preventing structure configured to prevent a positional shift of the contact member 20 in the axial direction relative to the female connector 30 pertaining to insertion and withdrawal of the male connector Tm1.

Figure 4:
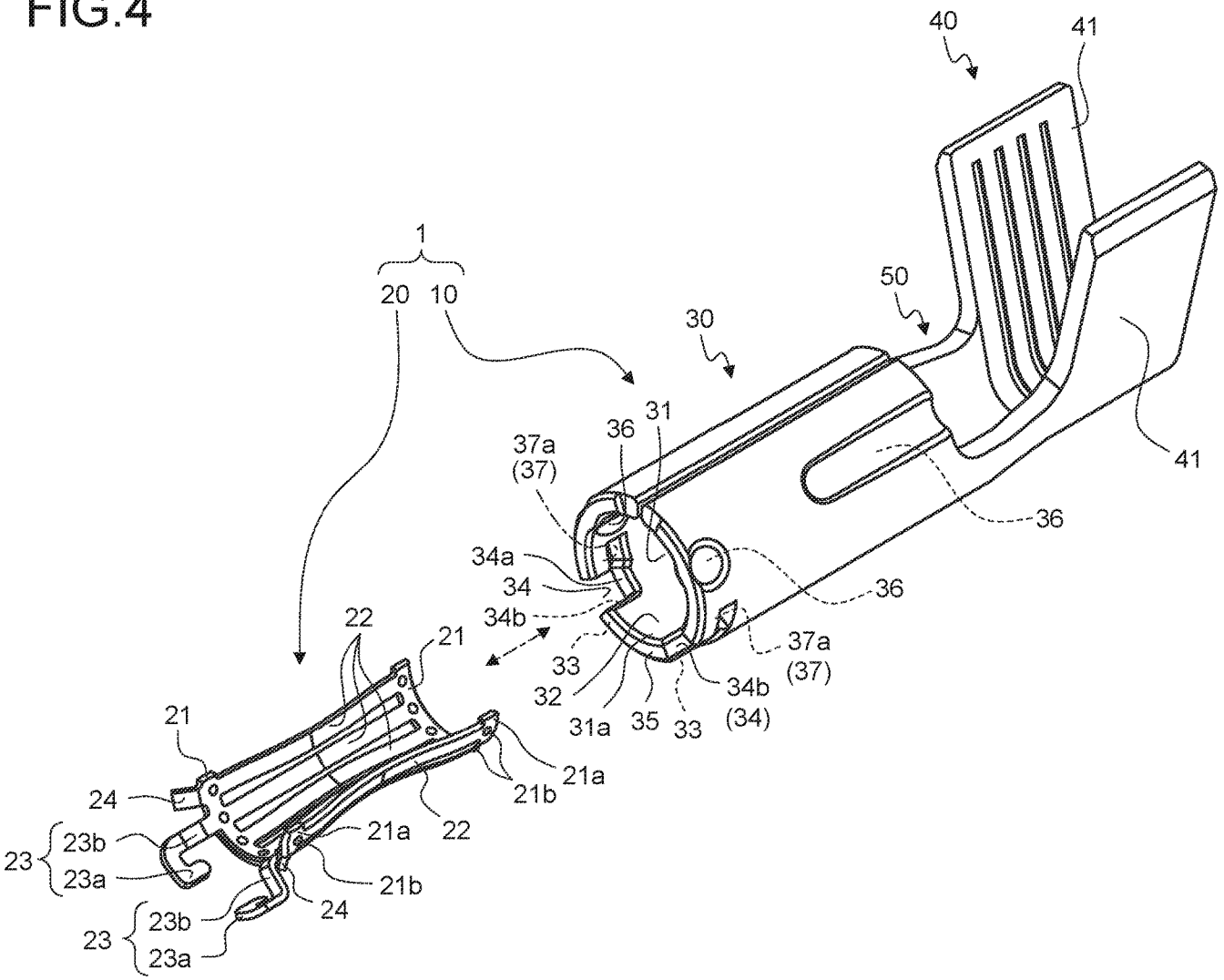
FIG. 4 is an exploded perspective view illustrating the connection terminal according to the embodiment.
Figure 5:
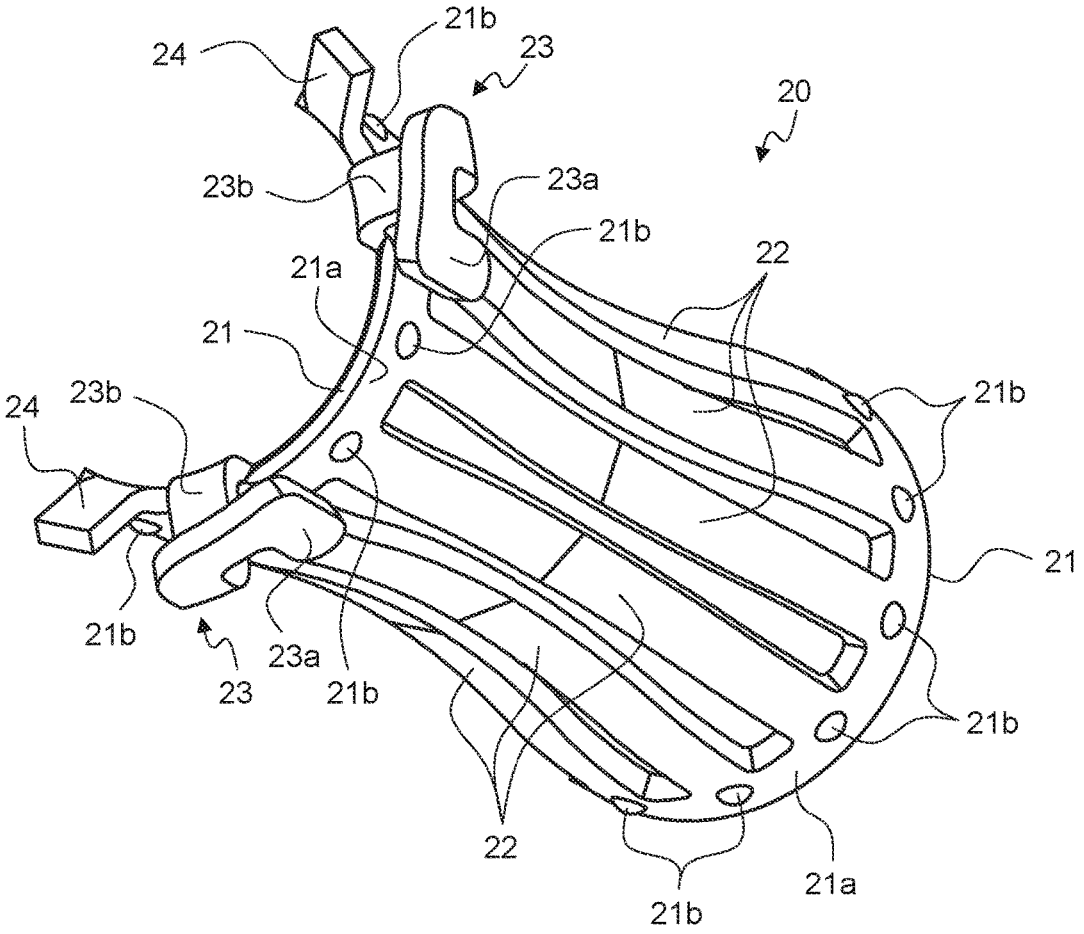
FIG. 5 is a perspective view illustrating a contact member according to the embodiment.
Figure 6:
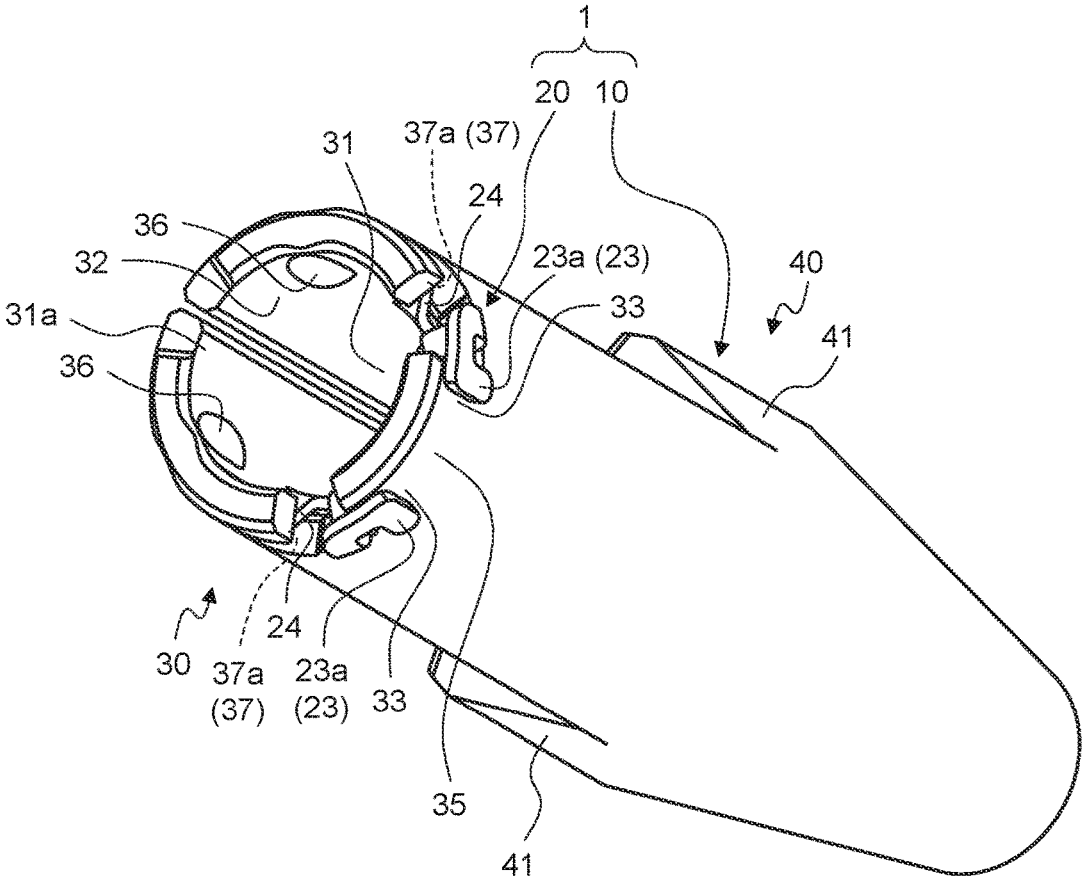
FIG. 6 is a perspective view of the connection terminal according to the embodiment as viewed from another angle.
Figure 7:
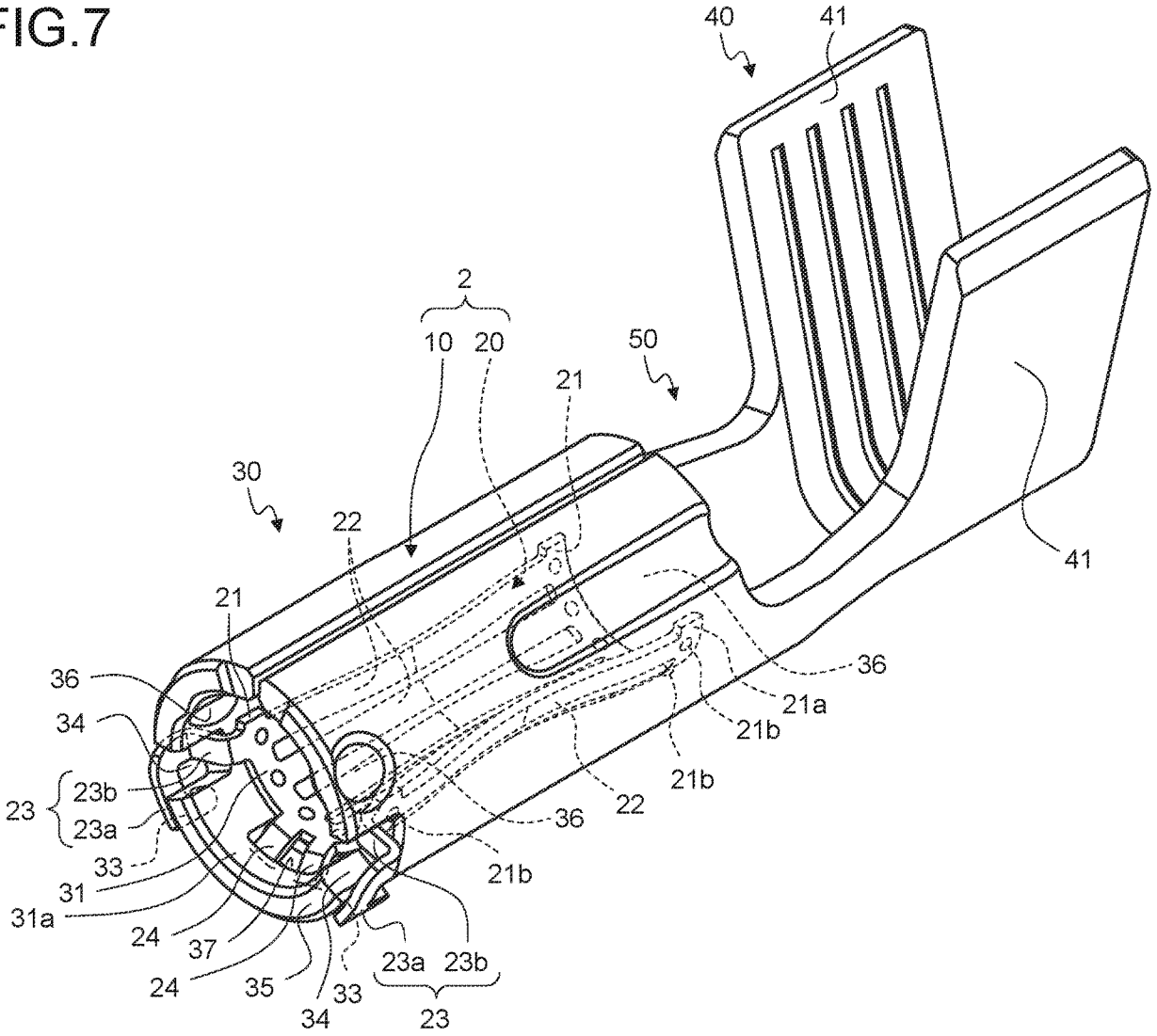
FIG. 7 is a perspective view illustrating a connection terminal of a first modification.
Figure 8:
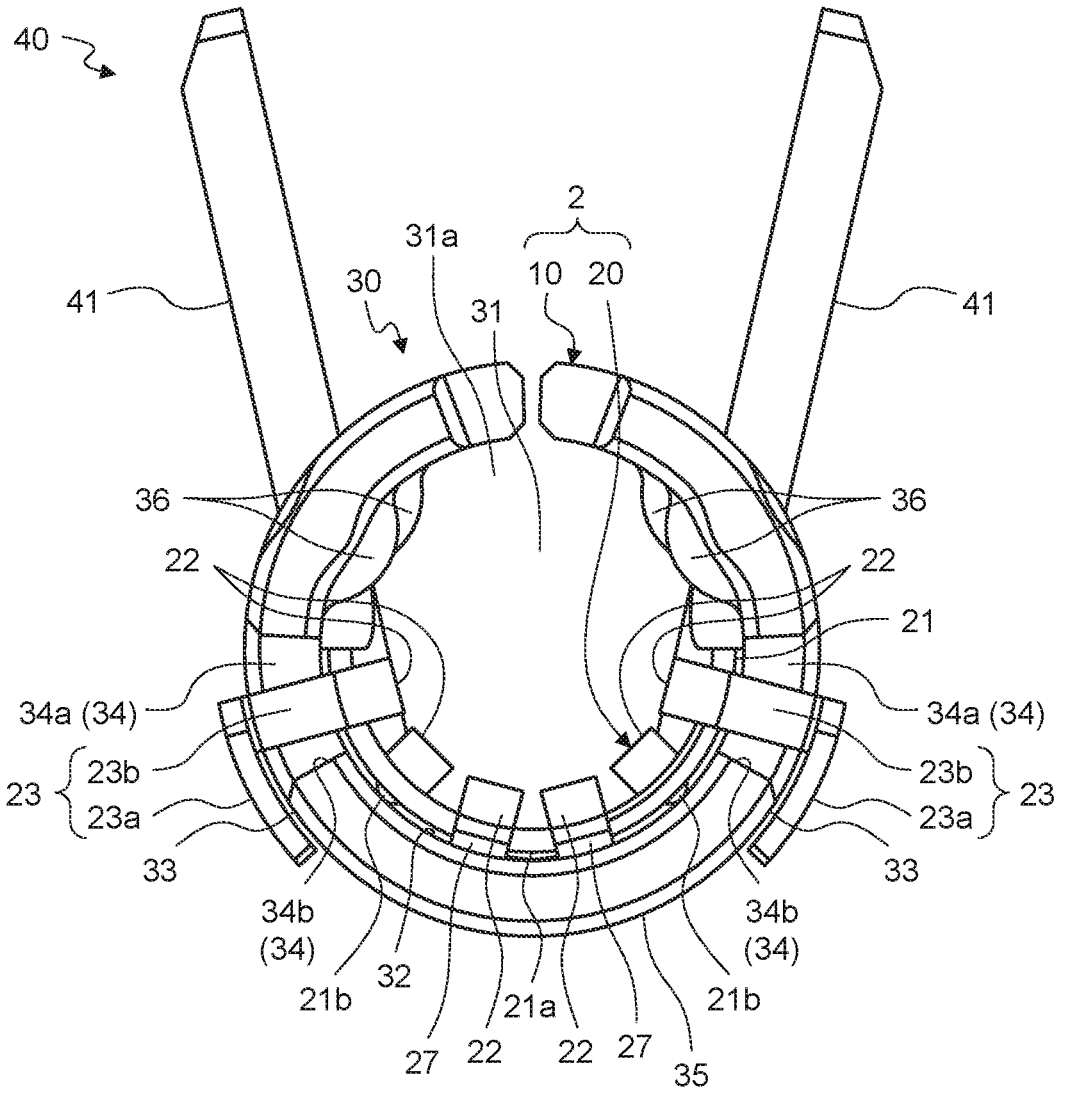
FIG. 8 is a front view illustrating the connection terminal of the first modification.
Figure 9:
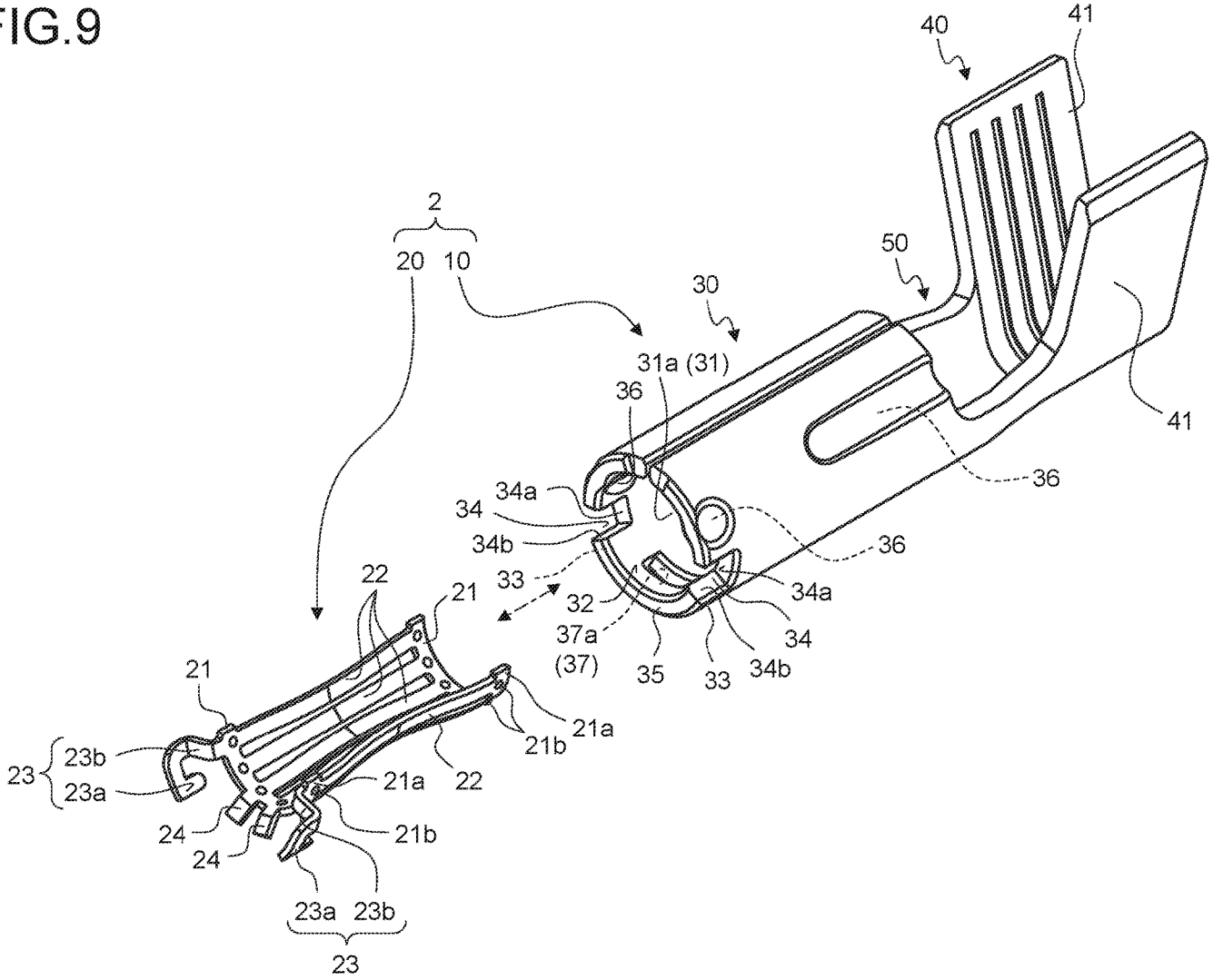
FIG. 9 is an exploded perspective view illustrating the connection terminal of the first modification.
Figure 10:
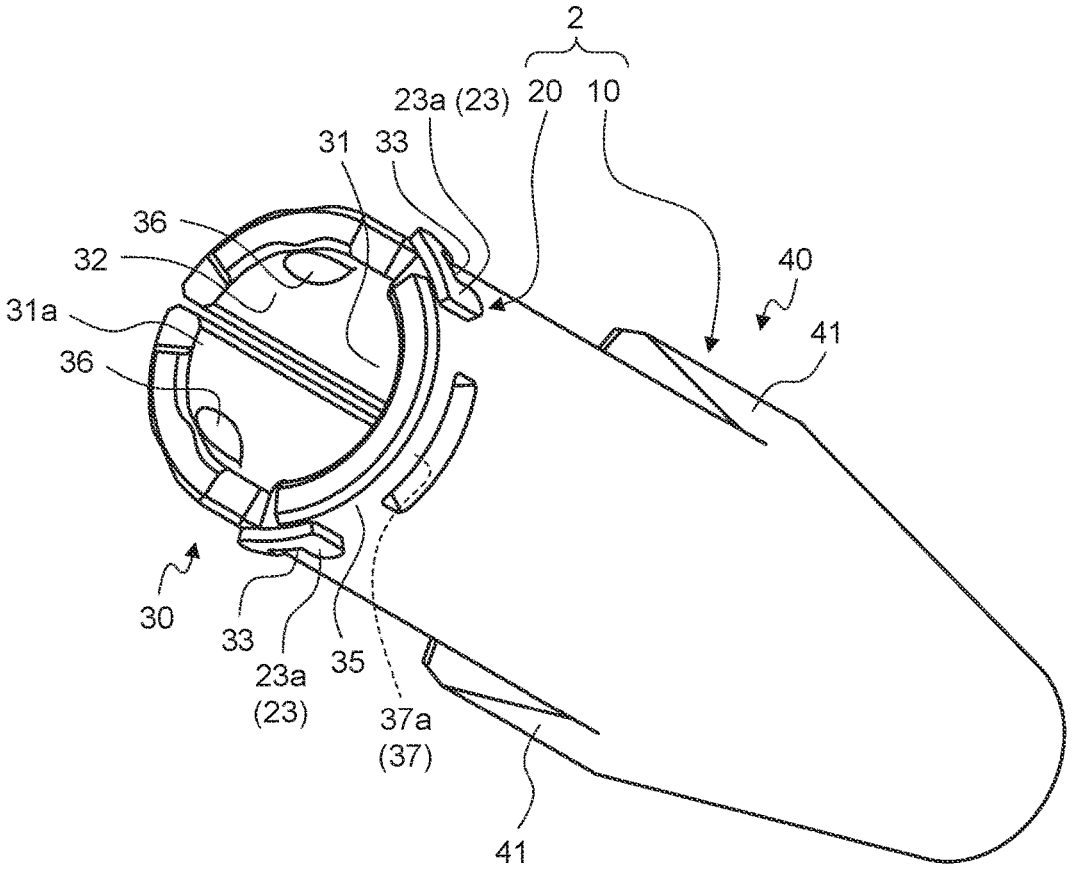
FIG. 10 is a perspective view of the connection terminal according to the first modification as viewed from another angle.
Figure 11:
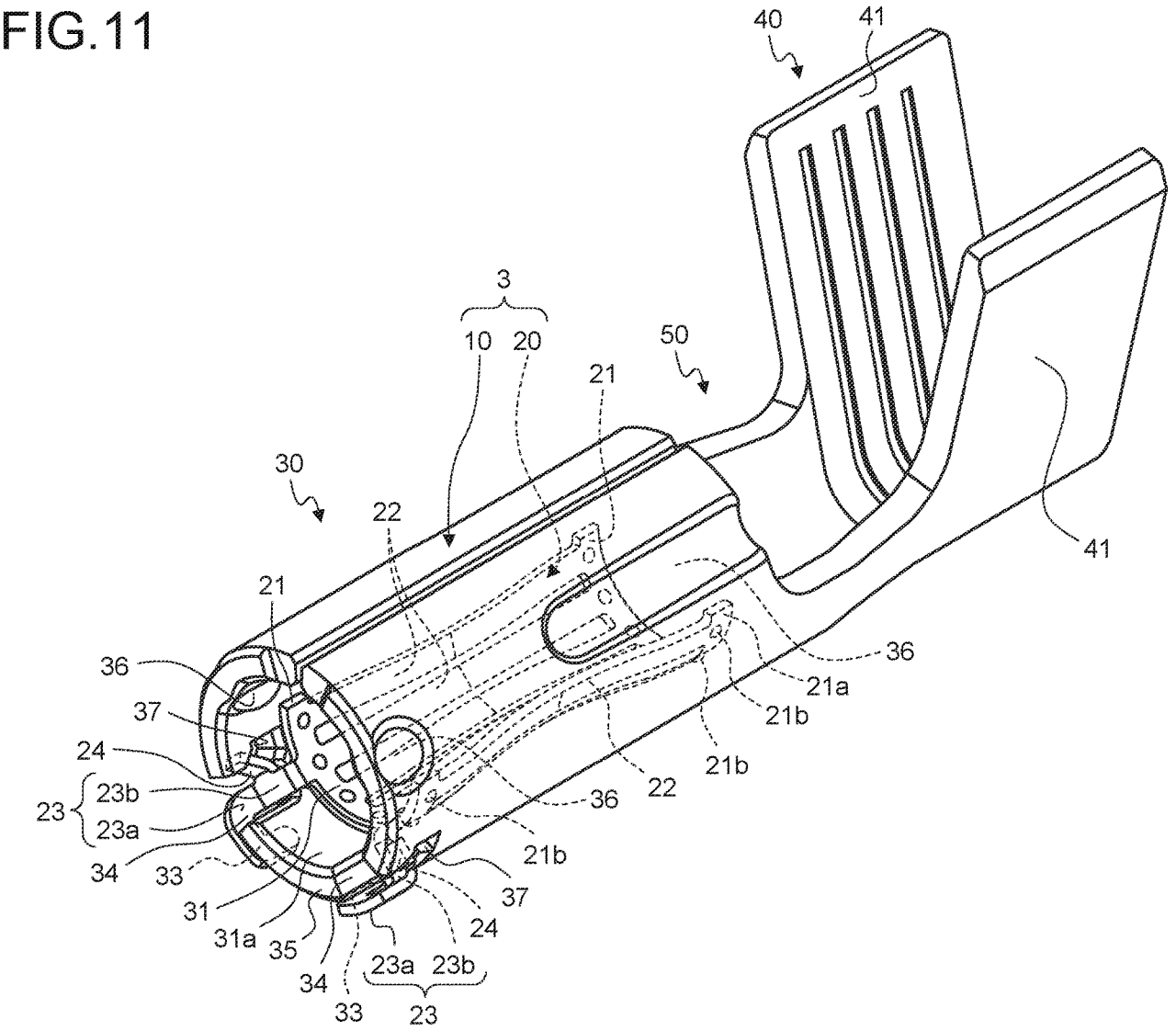
FIG. 11 is a perspective view illustrating a connection terminal of a second modification.
Figure 12:
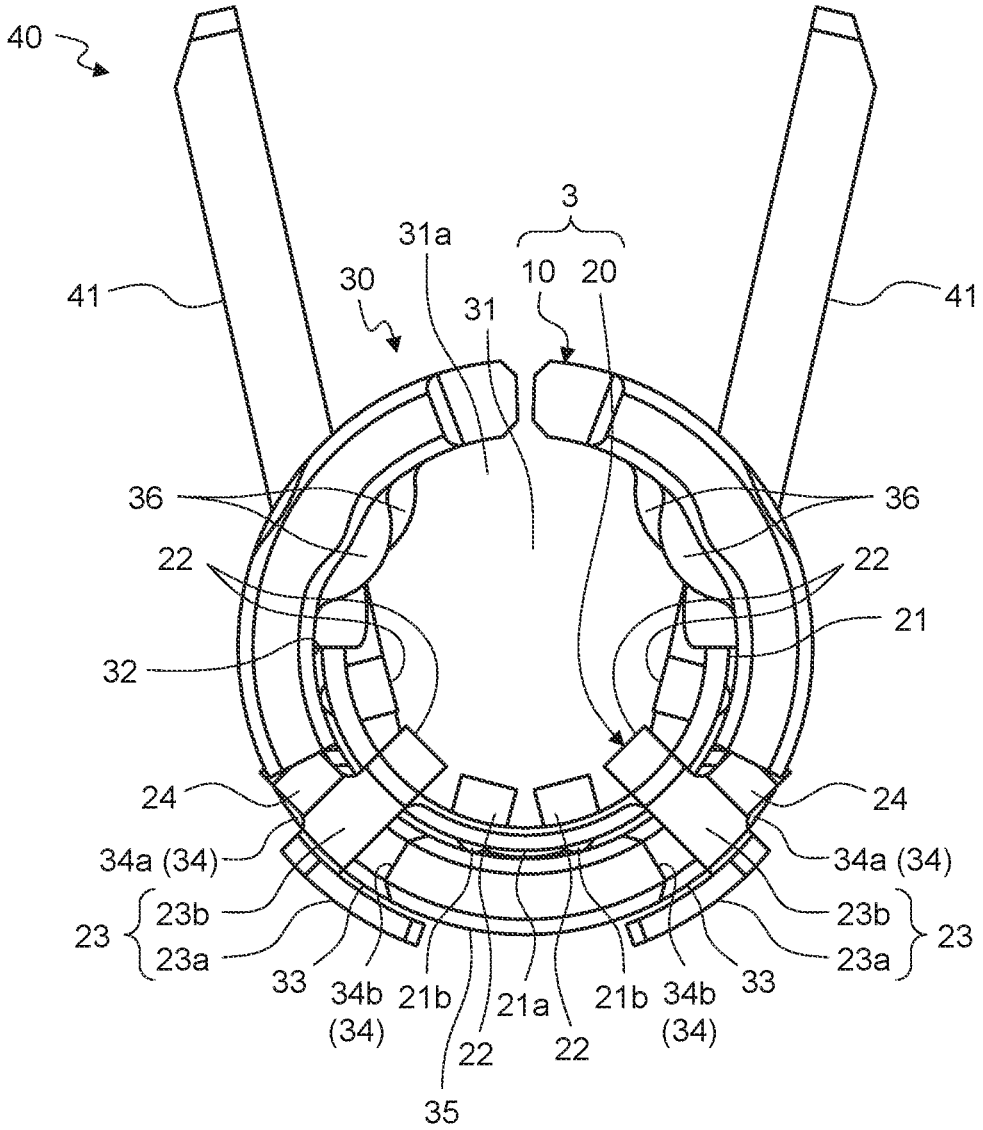
FIG. 12 is a front view illustrating the connection terminal of the second modification.
Figure 13:
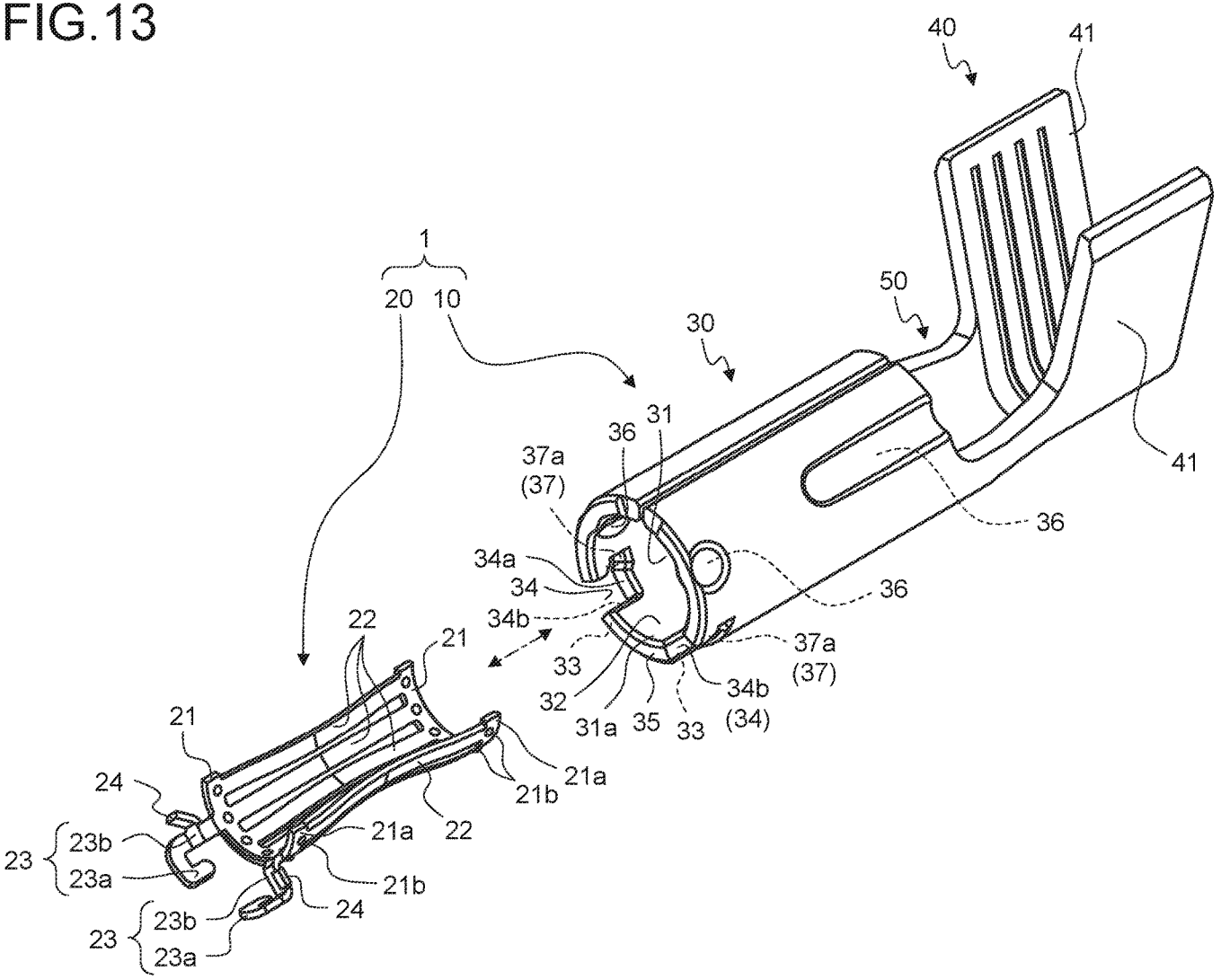
FIG. 13 is an exploded perspective view illustrating the connection terminal of the second modification.
Figure 14:
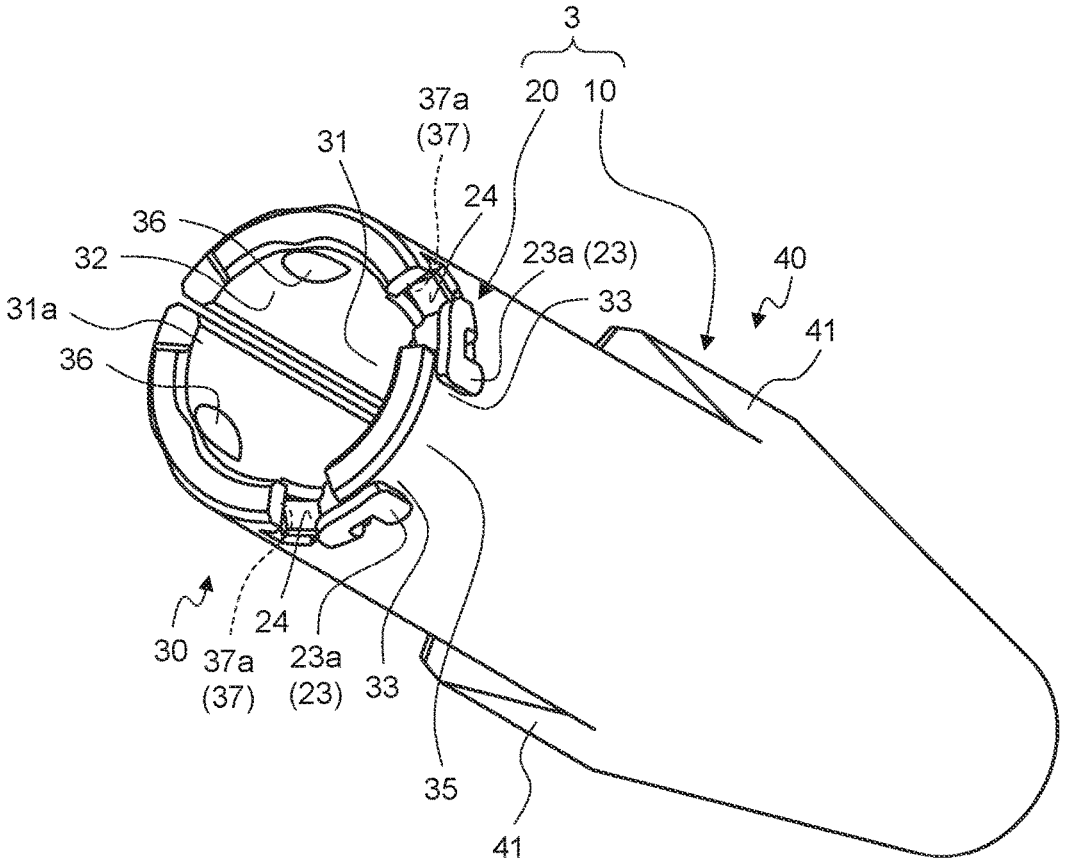
FIG. 14 is a perspective view of the connection terminal of the second modification as viewed from another angle.

For example, the coupling unit 23*b* of the uplift prevention unit 23 is locked at a base 34*a* of the notch 34 in the direction in which the male connector Tm1 is inserted (FIGS. 3 and 4). Therefore, the coupling unit 23*b* and the base 34*a* of the notch 34 can be utilized as the structure to prevent a positional shift of the contact member 20 during male terminal insertion. When the male connector Tm1 is inserted into the internal space 31, even though the contact member 20 begins to move relative to the female connector 30 due to frictional force with respect to the male connector Tm1, it is possible to hold the contact member 20 in the internal space 31 at a predetermined position due to a locking action between the coupling unit 23*b* and the base 34*a* of the notch 34. In such manners, this positional shift preventing structure is capable of preventing a positional shift of the contact member 20 in the axial direction relative to the internal space 31, which maintains electrical connection between the female connector 30 and the male connector Tm1. Furthermore, even when the contact member 20 is inserted into the internal space 31 from the opening 31*a*, this positional shift preventing structure is capable of locking the coupling unit 23*b* with the base 34*a* of the notch 34.

Still further, the coupling unit 23*b* is locked in the circumferential direction by a side wall of the arcuate portion 35 of the female connector 30 (a side wall 34*b* of the notch 34) (FIGS. 3 and 4). Therefore, the coupling unit 23*b* and the side wall 34*b* of the notch 34 can be utilized as the structure to prevent a positional shift of the contact member 20 in the circumferential direction. This structure to prevent a positional shift in the circumferential direction enables prevention of a positional shift of the contact member 20 in the circumferential direction during male terminal insertion or during insertion of the contact member 20 into the internal space 31.

In such manners, according to the positional shift preventing structure that includes the coupling unit 23*b* and the notch 34, it is possible to house the contact member 20 in the internal space 31 at a predetermined position and to hold the same at the position during male terminal insertion or during insertion of the contact member 20 into the internal space 31. Therefore, when attaching the contact member 20 to the terminal body 10, the positional shift preventing structure can be used for positioning those components.

On the other hand, a structure to prevent a positional shift of the contact member 20 during male terminal withdrawal includes the locked unit 24 during male terminal withdrawal provided in the contact member 20, and an insertion hole 37 provided in the female connector 30 (FIGS. 1, 2 and 4). The locked unit 24 protrudes outward in the radial direction from the first contact unit 21 (in this exemplified embodiment, the first contact unit 21 close to the opening 31*a*) and in a direction in which the male connector Tm1 is withdrawn. The locked unit 24 is formed into a substantially rectangular piece and is disposed in the insertion hole 37 of the female connector 30. The insertion hole 37 is a through hole formed for each locked unit 24, being configured to communicate the inner side of the female connector 30 in the radial direction (the internal space 31) and the outer side thereof. This exemplified insertion hole 37 is formed by cutting out the aforementioned notch 34 along the circumferential direction from an end close to a male terminal-inserting direction, and the insertion hole 37 includes a wall 37*a* serving as a locking unit on a side close to a male terminal-withdrawing direction. The locked unit 24 is locked by the wall 37*a* so as not to move in the male terminal-withdrawing direction. In this embodiment, two locked unit 24-and-insertion hole 37 sets are provided at an interval in the circumferential direction. In this embodiment, the locked unit 24-and-insertion hole 37 sets (the uplift preventing structure) are arranged so as to sandwich two uplift prevention unit 23-and-locking unit 33 sets in the circumferential direction (the structure to prevent a positional shift during male terminal withdrawal).

When the male connector Tm1 is withdrawn from the internal space 31 toward the opening 31*a*, even though the contact member 20 begins to move relative to the female connector 30 due to frictional force with respect to the male connector Tm1, the locked unit 24 is locked by the wall 37*a* of the insertion hole 37 so that the structure to prevent a positional shift of the contact member 20 during male terminal withdrawal can hold the contact member 20 in the internal space 31 at a predetermined position. Accordingly, this positional shift preventing structure is capable of preventing a positional shift of the contact member 20 in the axial direction relative to the internal space 31 so that the female connector 30 is electrically connected to the male connector Tm1 when the male connector Tm1 is re-inserted into the female connector 30.

In such manners, as the positional shift preventing structure and the aforementioned structure to prevent an uplift of the contact member 20 are disposed interdependently, the connection terminal 1 of this embodiment is capable of preventing the contact member 20 from falling off the female connector 30 even with the female connector 30 not being covered with a lid and the like.

First Modification

The reference numeral 2 in FIGS. 7 to 10 denotes a connection terminal of this modification. In a connection terminal 2 of this modification, components with functions similar to those of the connection terminal 1 in the aforementioned embodiment are denoted by the same reference numerals as those of the connection terminal 1 for sake of simplicity, and description thereof will be omitted.

The connection terminal 2 of this modification corresponds to the connection terminal 1 of the embodiment being changed in positional relationship between the uplift prevention unit 23-and-locking unit 33 set and the locked unit 24-and-insertion hole 37 set. Accordingly, various effects similar to those of the connection terminal 1 can be obtained from the connection terminal 2 of this modification.

This connection terminal 2 is provided with two uplift prevention unit 23-and-locking unit 33 sets as similar to the connection terminal 1 so that it is possible to prevent an uplift of the contact member 20 from the inner periphery 32 of the female connector 30.

In this connection terminal 2, it should be noted that each uplift prevention unit 23 is disposed at each end in the circumferential direction of the contact member 20. However, as similar to the connection terminal 1, the notch 34 into which the coupling unit 23*b* is inserted is provided at the end of the female connector 30 close to the opening 31*a* in accordance with arrangement of the coupling unit 23*b* of the uplift prevention unit 23. The connection terminal 2 is provided with the structure including the coupling unit 23*b* and the base 34*a* of the notch 34 to prevent a positional shift during male terminal insertion. Therefore, as similar to the connection terminal 1, during male terminal insertion or during insertion of the contact member 20 into the internal space 31, the connection terminal 2 of this modification is capable of preventing a positional shift of the contact member 20 relative to the internal space 31 along the inserting direction. Furthermore, as similar to the connection terminal 1, this connection terminal 2 is provided in the circumferential direction with the positional shift preventing structure that includes the coupling unit 23*b* and the side wall 34*b* of the notch 34 so that it is possible to prevent a positional shift of the contact member 20 in the circumferential direction relative to the internal space 31 during male terminal insertion or during insertion of the contact member 20 into the internal space 31.

In this connection terminal 2, the structure to prevent a positional shift of the contact member 20 during male terminal withdrawal (the locked unit 24 and the insertion hole 37) may be provided with two locked unit 24-and-insertion hole 37 sets configured as similar to those in the connection terminal 1. In this exemplified modification, in accordance with arrangement of the aforementioned two uplift prevention unit 23-and-locking unit 33 sets, the positional shift preventing structure is configured in the following manner.

In this connection terminal 2, the structure to prevent a positional shift during male terminal withdrawal is disposed between the two uplift prevention unit 23-and-locking unit 33 sets in the circumferential direction. The structure to prevent a positional shift during male terminal withdrawal according to this modification includes at least one locked unit 24 provided in the contact member 20, and the insertion hole 37 of the female connector 30 into which the locked unit 24 is inserted. The locked unit 24 of this modification is formed into a piece as similar to that of the embodiment, being disposed between two uplift prevention units 23 in the circumferential direction. In this exemplified modification, two locked units 24 are provided. The insertion hole 37 of this modification is a through hole similar to that of the embodiment, but is different in that all the locked units 24 provided in the contact member 20 are inserted into this insertion hole 37. Therefore, in this exemplified modification, one substantially rectangular insertion hole 37 formed along the circumferential direction is disposed between the two notches 34 in the circumferential direction of the female connector 30. In this insertion hole 37, the wall 37*a* close to the male terminal-withdrawing direction is used as a locking unit of the two locked units 24. Therefore, during male terminal withdrawal, the connection terminal 2 of this modification enables prevention of a positional shift of the contact member 20 relative to the internal space 31 along the withdrawing direction, as similar to the connection terminal 1.

In such manners, in the connection terminal 2 of this modification, one structure to prevent an uplift of the contact member 20 (the uplift prevention unit 23-and-locking unit 33 set) is disposed circumferentially outside the structure to prevent a positional shift of the contact member 20 during male terminal withdrawal (the set including two locked units 24 and one insertion hole 37). In this connection terminal 2, each of those two uplift prevention units 23 is disposed at each end in the circumferential direction of the contact member 20. Therefore, when assuming that a physical size (that is, an arc length) in the circumferential direction of the contact member 20 herein is substantially equal to that of the connection terminal 1 of the embodiment, the connection terminal 2 of this modification is capable of preventing an uplift of the first contact unit 21, or the target of coupling, from the inner periphery 32 of the female connector 30 more effectively than the connection terminal 1. Accordingly, this connection terminal 2 can obtain effects of preventing an uplift of the contact member 20 more reliably than the connection terminal 1 of the embodiment.

Second Modification

The reference numeral 3 in FIGS. 11 to 14 denotes a connection terminal of this modification. In a connection terminal 3 of this modification, components with functions similar to those of the connection terminal 1 in the aforementioned embodiment are denoted by the same reference numerals as those of the connection terminal 1 for sake of simplicity, and description thereof will be omitted.

The connection terminal 3 of this modification corresponds to the connection terminal 1 of the embodiment being changed in arrangement of the structure to prevent a positional shift of the contact member 20 during male terminal withdrawal. Accordingly, various effects similar to those of the connection terminal 1 can be obtained from the connection terminal 3 of this modification.

This connection terminal 3 is provided with two sets of combinations of the uplift prevention unit 23 and the locking unit 33 configured similar to those as in the connection terminal 1. Therefore, the connection terminal 3 is capable of preventing an uplift of the contact member 20 from the inner periphery 32 of the female connector 30. Furthermore, in this connection terminal 3, the notch 34 formed and disposed as similar to that in the connection terminal 1 is provided at the end of the female connector 30 close to the opening 31*a*. Therefore, the connection terminal 3 is provided with the structure to prevent a positional shift during male terminal insertion which includes the coupling unit 23*b* of the uplift prevention unit 23 and the base 34*a* of the notch 34, and the structure to prevent a positional shift in the circumferential direction which includes the coupling unit 23*b* and the side wall 34*b* of the notch 34. Accordingly, as similar to the connection terminal 1, during male terminal insertion or during insertion of the contact member 20 into the internal space 31, the connection terminal 3 of this modification is capable of preventing a positional shift of the contact member 20 relative to the internal space 31 along the inserting direction and is capable of preventing a positional shift of the contact member 20 in the circumferential direction relative to the internal space 31.

On the other hand, the structure to prevent a positional shift of the contact member 20 during male terminal withdrawal is configured as similar to that in the connection terminal 1 and includes the locked unit 24 provided in the contact member 20, and the wall 37*a* of the insertion hole 37 provided in the female connector 30. Two sets of these components are provided at an interval in the circumferential direction. However, in this modification, the locked unit 24 and the uplift prevention unit 23 are formed in an integrated manner. This exemplified locked unit 24 protrudes in the circumferential direction from the coupling unit 23*b* of the uplift prevention unit 23 (in a direction opposite to the other uplift prevention unit 23-and-locking unit 33 set) and in the direction of withdrawing the male connector Tm1. The locked unit 24 is formed into a substantially rectangular piece and is disposed in the insertion hole 37 of the female connector 30. This insertion hole 37 is a through hole similar to that of the connection terminal 1, and is notched along the circumferential direction from the end of the notch 34 close to the male terminal-inserting direction so that the insertion hole 37 includes the wall 37*a* serving as a locking unit in the male terminal-withdrawing direction. Therefore, during male terminal withdrawal, the connection terminal 3 of this modification enables prevention of a positional shift of the contact member 20 relative to the internal space 31 along the withdrawing direction, as similar to the connection terminal 1.

Third Modification

The reference numeral 4 in FIGS. 15 to 18 denotes a connection terminal of this modification. In the connection terminal 4 of this modification, components with functions similar to those of the connection terminal 1 in the aforementioned embodiment are denoted by the same reference numerals as those of the connection terminal 1 for sake of simplicity, and description thereof will be omitted.

The connection terminal 4 of this modification corresponds to the connection terminal 1 of the embodiment being changed in the follow points.

First, in the connection terminal 4 of this modification, the contact member 20 is disposed in the internal space 31 of the female connector 30 on the circumferentially opposite side of the connection terminal 1 according to the embodiment (a position shifted by substantially 180 degrees). Therefore, in the connection terminal 4 of this modification, the four contact units 36 are also arranged in the internal space 31 on the circumferentially opposite side of the connection terminal 1 according to the embodiment (positions shifted by substantially 180 degrees). However, the circumferential arrangement of the contact member 20 and that of the contact unit 36 in the internal space 31 are not necessarily limited to an aspect of this modification, and may be similar to, for example, the aforementioned embodiment.

Next, the connection terminal 4 of this modification is different from the connection terminal 1 in shape of the uplift prevention unit 23 of the contact member 20. The uplift prevention unit 23 of this modification includes the locked unit 23*a* and the coupling unit 23*b* as similar to the connection terminal 1, but additionally includes a protruding portion 23*c* (see FIG. 17). In the uplift prevention unit 23, the protruding portion 23*c* protrudes in the male terminal-withdrawing direction from the first contact unit 21, or the target of coupling, and the coupling unit 23*b* protrudes outward in the radial direction from a protruding end of the protruding portion 23*c*, and the locked unit 23*a* protrudes in the male terminal-inserting direction from the protruding end of the coupling unit 23*b*. Each of the exemplified locked unit 23*a*, coupling unit 23*b*, and protruding portion 23*c* is formed into a substantially rectangular piece. As similar to the connection terminal 1, the exemplified locked unit 23*a* is disposed so that the inner wall surface in the radial direction opposes the locking unit 33 of the female connector 30.

Figure 15:
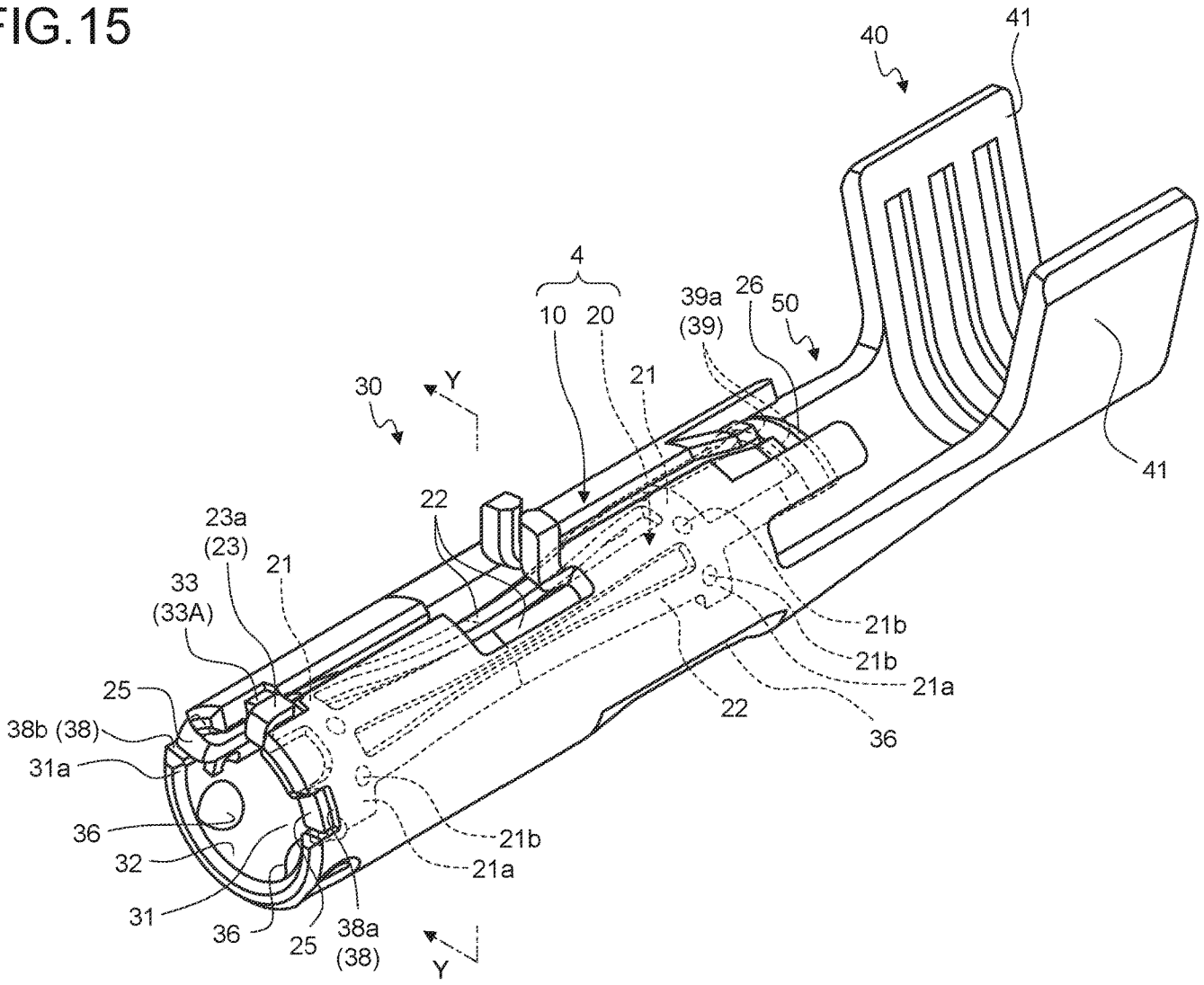
FIG. 15 is a perspective view illustrating a connection terminal of a third modification.
Figure 16:
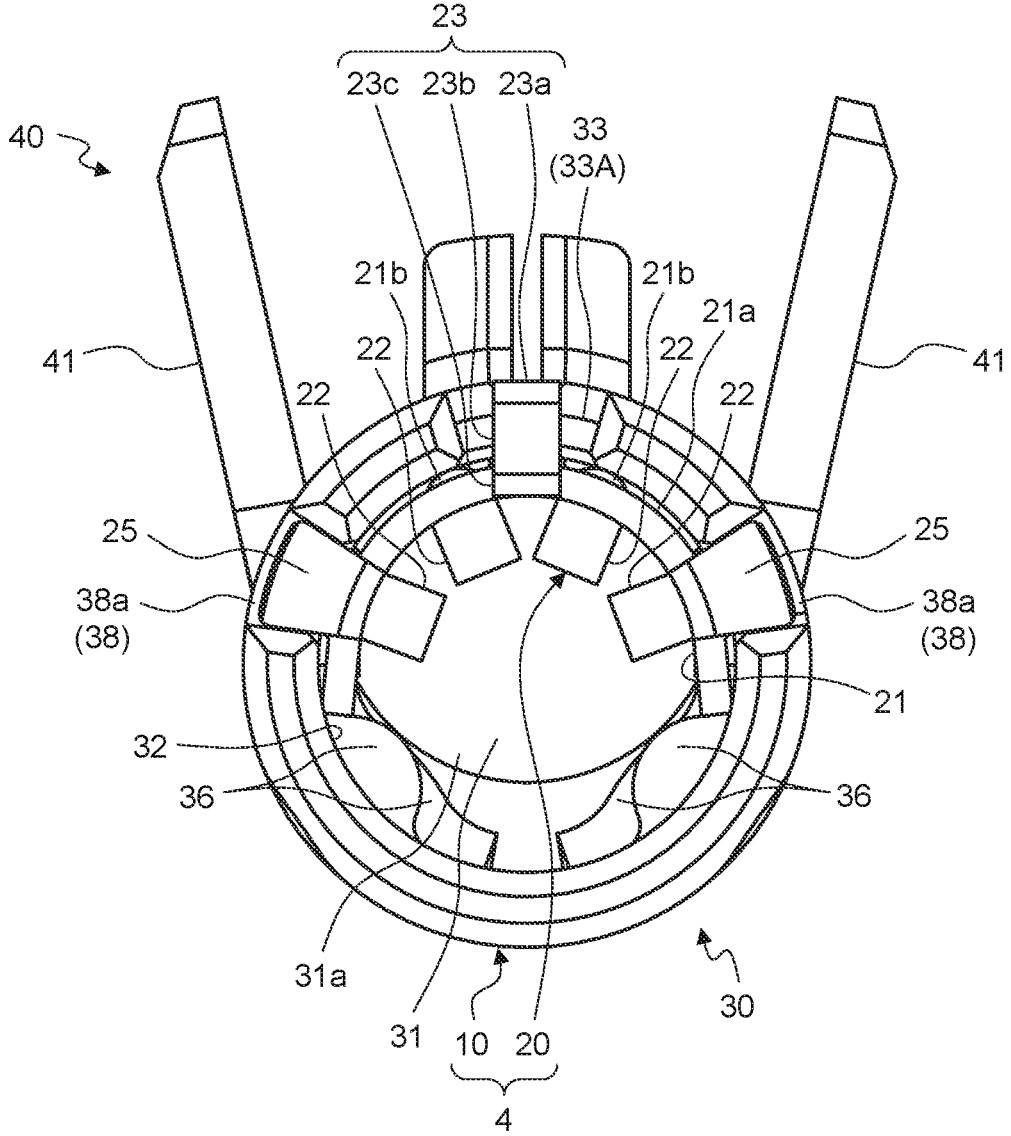
FIG. 16 is a front view illustrating the connection terminal of the third modification.
Figure 17:
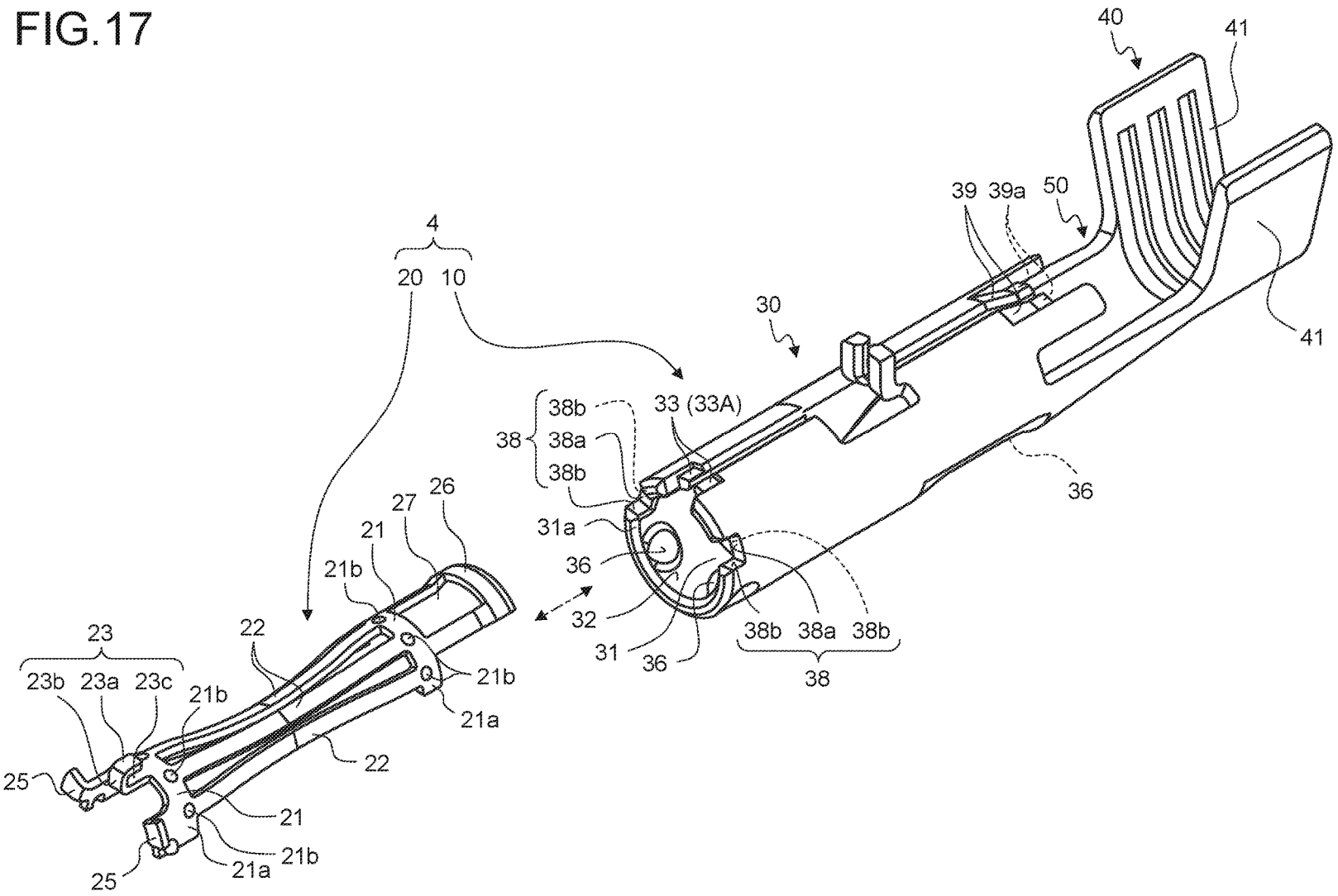
FIG. 17 is an exploded perspective view illustrating the connection terminal of the third modification.

The locking unit 33 of this modification is provided in accordance with shape and arrangement of the uplift prevention unit 23. As similar to the connection terminal 1, the locking unit 33 may be a part of the outer periphery of the female connector 30. In this exemplified female connector 30, it should be noted that a recess 33A recessed inward in the radial direction is formed in a part of the end close to the opening 31*a* in the outer periphery (FIGS. 15 to 17). In this modification, a bottom surface in the radial direction of the recess 33A is used as the locking unit 33.

At least one uplift prevention unit 23-and-locking unit 33 set may be provided in the circumferential direction. In the connection terminal 4 of this modification, one uplift prevention unit 23-and-the locking unit 33 set is provided. In this exemplified modification, the uplift prevention unit 23 is positioned substantially at the center in the circumferential direction of the first contact unit 21, or the target of coupling, and the locking unit 33 is provided in accordance with the position of the uplift prevention unit 23. Therefore, in the structure to prevent an uplift of the contact member 20 of this modification, the contact member 20 can be prevented from being uplifted from the inner periphery 32 of the female connector 30 by one uplift prevention unit 23-and-locking unit 33 set.

In the connection terminal 4 of this modification, in order to prevent the contact member 20 from protruding in the male terminal-withdrawing direction with respect to the female connector 30, the end of the female connector 30 close to the opening 31*a* may be notched so that the coupling unit 23*b* may be housed in the notch.

Herein, the connection terminal 4 of this modification is provided with the following structure to prevent a positional shift of the contact member 20 during male terminal insertion, and the following structure to prevent a positional shift of the contact member 20 during male terminal withdrawal.

The structure to prevent a positional shift during male terminal insertion includes a first locked unit 25 provided in the first contact unit 21 including the uplift prevention unit 23 (FIGS. 15 to 17). The first locked unit 25 protrudes outward in the radial direction from the first contact unit 21. This exemplified first locked unit 25 is formed into a substantially rectangular piece. The female connector 30 includes a notch 38, into which the first locked unit 25 is inserted, at the end close to the opening 31*a* (FIGS. 15 to 17). A wall surface of the first locked unit 25 close to the male terminal-inserting direction opposes the base 38*a* in the axial direction of the notch 38. Therefore, in this exemplified modification, the base 38*a* is used as a locking unit of the first locked unit 25, and the first locked unit 25 is locked by the base 38*a*. In other words, herein, the first locked unit 25 and the base 38*a* are included in the structure to prevent a positional shift during male terminal insertion. During male terminal insertion or during insertion of the contact member 20 into the internal space 31, the structure prevents a positional shift, relative to the internal space 31, of the contact member 20 facing the inserting direction. In this exemplified modification, two first locked unit 25-and-base 38*a* sets are provided at an interval in the circumferential direction. Herein, the structure to prevent an uplift of the contact member 20 is disposed between those two first locked unit 25-and-base 38*a* sets.

Furthermore, in this connection terminal 4, the first locked unit 25 can be locked by the side wall 38*b* of the notch 38 in the circumferential direction (FIG. 17). Therefore, the connection terminal 4 is provided with the positional shift preventing structure including the first locked unit 25 and the side wall 38*b* of the notch 38 so that it is possible to prevent a positional shift of the contact member 20 in the circumferential direction relative to the internal space 31 during male terminal insertion or during insertion of the contact member 20 into the internal space 31.

In this connection terminal 4, the wall surface of the coupling unit 23*b* of the uplift prevention unit 23 in the male terminal-inserting direction and an end face of the female connector 30 close to the opening 31*a* oppose each other in the axial direction. Therefore, in the connection terminal 4, these may be used as the structure to prevent a positional shift during male terminal insertion.

Figure 18:
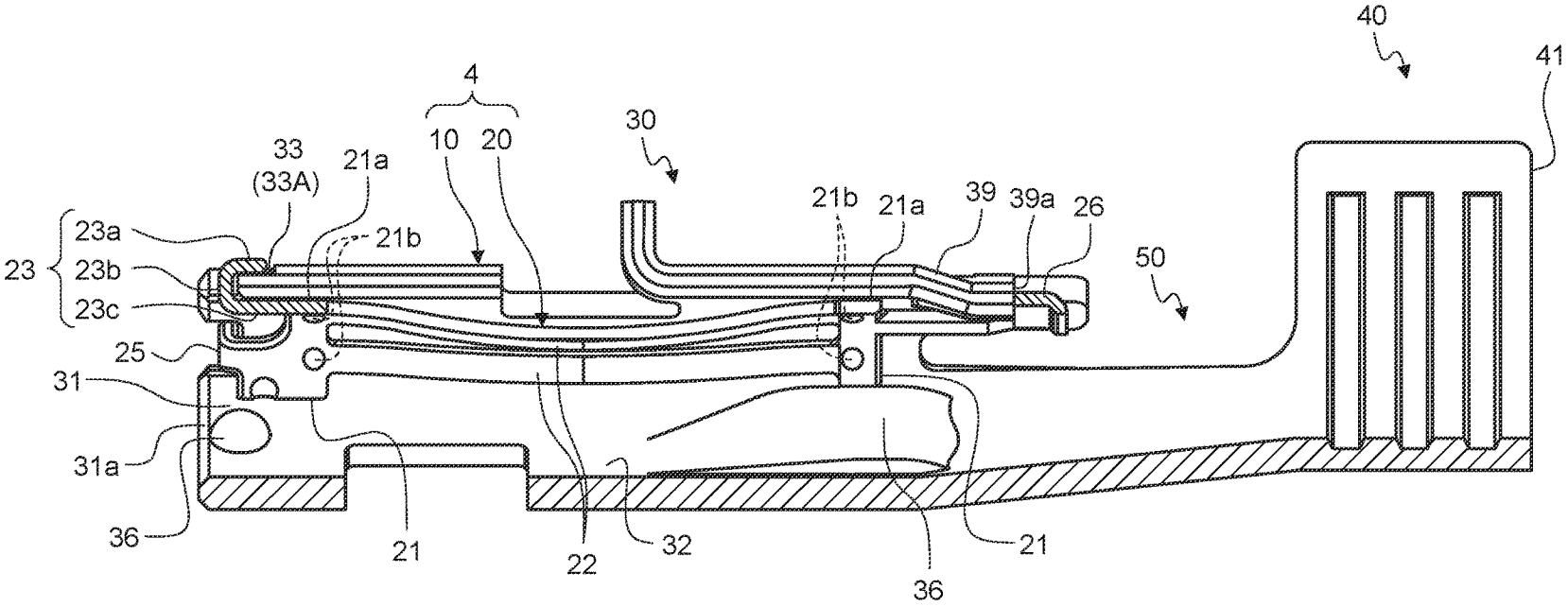
FIG. 18 is a cross-sectional view taken along line Y-Y of FIG. 15.

The structure to prevent a positional shift during male terminal withdrawal includes a second locked unit 26 provided in the contact member 20 (FIGS. 15, 17 and 18). The exemplified second locked unit 26 is provided at the end of the contact member 20 close to the coupler 50. In this exemplified modification, an arcuate portion disposed at an interval in the axial direction from the first contact unit 21 close to the coupler 50 is utilized as the second locked unit 26 (FIG. 17). As the second locked unit 26 is locked by the female connector 30 during male terminal withdrawal, this connection terminal 4 can prevent a positional shift of the contact member 20 relative to the internal space 31 during male terminal withdrawal. Accordingly, the female connector 30 of this modification is provided with an inclined portion 39 which is inclined inward in the radial direction at the end close to the coupler 50. In this exemplified modification, an end face 39*a* of the inclined portion 39 close to the coupler 50 is used as a locking unit of the second locked unit 26, and the second locked unit 26 is locked at the end face 39*a* during male terminal withdrawal (FIG. 18). In other words, herein, the second locked unit 26 and the end face 39*a* of the inclined portion 39 are included in the structure to prevent a positional shift during male terminal withdrawal. Specifically, the contact member 20 of this modification is provided with a through hole 27 between the first contact unit 21 and the second locked unit 26 close to the coupler 50. The through hole 27 is where the inclined portion 39 is inserted after the inclined portion 39 is housed in the internal space 31 of the contact member 20 (FIG. 17). The end face 39*a* of the inclined portion 39 opposes the second locked unit 26 in the axial direction, while being inserted into the through hole 27. Therefore, during male terminal withdrawal, this positional shift preventing structure can prevent a positional shift of the contact member 20 relative to the internal space 31 in the withdrawing direction. Furthermore, as an interval between each side wall of the through hole 27 in the circumferential direction and the inclined portion 39 is reduced, the positional shift preventing structure is capable of preventing a positional shift of the contact member 20 in the circumferential direction relative to the female connector 30.

A connection terminal according to an embodiment of the present invention is capable of preventing an uplift of a contact member from an inner periphery of a female connector. Accordingly, when a male connector is inserted into an internal space of the female connector, it is possible to avoid interference of the male connector with the contact member and to allow the male connector to push a second contact unit outward in a radial direction. Therefore, this connection terminal not only enables electrical connection between the female connector and the contact member and between the male connector and the contact member, but also improves durability of the contact member. Furthermore, this connection terminal improves not only the durability of the connection terminal but also durability of the male connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal, comprising:

a terminal body that is formed of a conductive material and includes a female connector provided with an internal space having a cylindrical shape into which a male connector of a counterpart male terminal is inserted, and a wire connector to which a conductive unit of a wire is electrically connected; and a contact member that is formed of a conductive material, is housed in the internal space along a part of an inner periphery of the female connector in a circumferential direction, is electrically connected to the female connector, and is electrically connected to the male connector inserted into the internal space from an opening serving as a male terminal inlet port in the female connector, wherein the contact member includes a first contact unit that is formed into an arc along the circumferential direction of the inner periphery of the female connector with an arcuate outer periphery being electrically connected to the inner periphery of the female connector, a second contact unit that is disposed in the internal space while being connected to the first contact unit and is pushed outward in a radial direction of the internal space by the male connector inserted into the internal space and is electrically connected to the male connector, and an uplift prevention unit that is locked at an outer wall surface of the female connector not to move inward in the radial direction so as to prevent an uplift of the first contact unit from the inner periphery of the female connector.

2. The connection terminal according to claim 1, wherein the uplift prevention unit is disposed outside the female connector in the radial direction, and includes a locked unit that is locked at the outer wall surface of the female connector not to move inward in the radial direction, and a coupling unit that couples the locked unit with the first contact unit.

3. The connection terminal according to claim 1, wherein the contact member includes at least two of the first contact unit arranged at an interval in an axial direction of the female connector and a plurality of the second contact unit serving as coupling units to couple the two adjacent first contact units with each other, and the second contact units are formed into an arc projecting inward in the radial direction between the two adjacent first contact units so as to be bent outward in the radial direction when being pushed outward in the radial direction by the male connector inserted into the internal space.

4. The connection terminal according to claim 2, wherein the contact member includes at least two of the first contact unit arranged at an interval in an axial direction of the female connector and a plurality of the second contact unit serving as coupling units to couple the two adjacent first contact units with each other, and the second contact units are formed into an arc projecting inward in the radial direction between the two adjacent first contact units so as to be bent outward in the radial direction when being pushed outward in the radial direction by the male connector inserted into the internal space.

5. The connection terminal according to claim 3, wherein the uplift prevention unit is connected to the first contact unit disposed close to the opening of the female connector.

6. The connection terminal according to claim 4, wherein the uplift prevention unit is connected to the first contact unit disposed close to the opening of the female connector.

* * * * *